US006203339B1

(12) United States Patent
Nieminen

(10) Patent No.: US 6,203,339 B1
(45) Date of Patent: Mar. 20, 2001

(54) ADAPTER FOR DUAL CIRCUIT TRACK LIGHTING SYSTEM

(75) Inventor: Eero Nieminen, Espoo (FI)

(73) Assignee: Nordic Aluminum, Ltd. (FI)

( * ) Notice: Subject to any disclaimer, the term of this patent is extended or adjusted under 35 U.S.C. 154(b) by 0 days.

(21) Appl. No.: 09/326,777

(22) Filed: Jun. 4, 1999

(51) Int. Cl.[7] ..... H01R 25/00
(52) U.S. Cl. ..... 439/118; 439/217
(58) Field of Search ..... 439/118, 217, 439/119, 210, 214, 215, 117, 212, 213

(56) References Cited

U.S. PATENT DOCUMENTS

| | | | | |
|---|---|---|---|---|
| 4,217,018 | * | 8/1980 | Yoshida et al. | 439/118 |
| 4,609,979 | | 9/1986 | Kristofek . | |
| 4,626,969 | | 12/1986 | Kristofek . | |
| 4,755,920 | | 7/1988 | Tinley . | |
| 4,851,973 | | 7/1989 | Layne . | |
| 4,919,625 | | 4/1990 | Coutre . | |
| 5,574,600 | | 11/1996 | Agro . | |
| 5,653,412 | | 8/1997 | Martorano et al. . | |
| 5,664,876 | | 9/1997 | Vafai et al. . | |
| 5,759,051 | * | 6/1998 | Cancellieri et al. | 439/118 |

* cited by examiner

*Primary Examiner*—Khiem Nguyen
*Assistant Examiner*—J. F. Duverne
(74) *Attorney, Agent, or Firm*—Kilpatrick Stockton LLP

(57) ABSTRACT

A track adapter (10) is disclosed for electrically connecting a light fixture to either of two electrical circuits (42, 43) of a track (22). The track adapter (10) includes a housing (14) and a housing base (12) having a slot (72) formed therein. An electrical contact (20, 220) has an elongated leg (120, 240) which is received through the slot (72) such that a first end (154) of the contact (20, 220) terminates within the housing (14). The electrical contact (20, 220) is movable within the slot (72) between a lower position in which the electrical contact (20, 220) contacts the voltage bus (42) of a first electrical circuit within the track (22) when the adapter (10) is mounted to the track, and an upper position in which the electrical contact (20, 220) contacts the voltage bus (43) of a second electrical circuit within the track. The electrical contact (20, 220) has a lateral protrusion (150, 250) which creates an interference fit with the slot (72) so as to inhibit the electrical contact (20, 220) from moving between the upper and lower positions. The protrusion (150, 250) is disposed above an upper end of the slot (72) when the electrical contact is in its upper position, and the protrusion (150, 250) is disposed below a lower end of the slot (72) when the electrical contact (20, 220) is in its lower position.

7 Claims, 13 Drawing Sheets

ADAPTER FOR DUAL CIRCUIT TRACK LIGHTING SYSTEM

TECHNICAL FIELD

The present invention relates generally to track lighting systems and relates more specifically to a track adapter for mounting a light fixture to a track and for making an electrical connection between the light fixture and the track.

BACKGROUND OF THE INVENTION

Track lighting systems are well known. The systems typically comprise a track which is mounted to the ceiling or wall and which is connected to an electrical supply source. The track is a hollow, elongated extrusion having neutral and voltage busses mounted within the track and running the length thereof. One or more lighting fixtures are sidably mounted to the track such that they can be moved to desired locations along the length of the track. Each lighting fixture is coupled to the track—both mechanically and electrically—by means of a track adapter. The track adapter includes neutral and voltage electrical contacts which are disposed to conductively communicate with the voltage and neutral electrical busses in the track. In addition the track adapter includes a ground contact which either engages a ground bus running the length of the track or contacts the track extrusion to ground the circuit. Thus the track adapter electrically connects the associated light fixture to the source of electrical power.

A variation on standard track lighting is the dual circuit track lighting system. In this arrangement two separate voltage busses are mounted within the track and run the length thereof. The ground and neutral contacts of the track adapter are fixed in position, but the voltage contact is movable with respect to the track adapter between a first position in which the voltage contact electrically couples to the first voltage bus of the track, and a second position in which the voltage contact electrically couples to the second voltage bus. By selectively mounting the lighting fixtures to contact either the first or second circuit, it is possible for one track light to be operated independently of a second track light mounted to the same track.

Conventional track adapters for dual circuit track lighting systems rely on frictional engagement between the voltage electrical contact and a corresponding slot in the track adapter to maintain the voltage contact in its first or second position. This arrangement is problematic, however, in that too much frictional engagement will make the voltage contact difficult to move between its first and second positions, while too little frictional engagement will permit the voltage contact to move unintentionally from one position to the other, or even to an intermediate position in which the voltage contact fails to contact either voltage bus.

Consequently there is a need for a track adapter for dual circuit track lighting systems which includes a mechanism for affirmatively maintaining the voltage contact in its desired position while permitting easy movement of the voltage contact between its two positions. There is a further need for a track adapter for dual circuit track lighting systems which reduces the likelihood that the voltage contact will be placed in an intermediate position in which the voltage contact fails to contact either voltage bus.

SUMMARY OF THE INVENTION

Stated generally, the present invention comprises a track adapter for dual circuit track lighting systems which includes a mechanism for affirmatively maintaining the voltage contact in either of two predetermined positions while permitting easy movement of the voltage contact between the two positions. The mechanism reduces the likelihood that the voltage contact will be placed in an intermediate position in which the voltage contact fails to contact either voltage bus. The mechanism also reduces the likelihood that the contact will accidentally be moved out of its desired position.

Stated somewhat more specifically, the present invention relates to a track adapter for electrically connecting a light fixture to either of two electrical circuits of a track. The track adapter includes a housing and a housing base having a slot formed therein. An electrical contact has an elongated leg which is received through the slot such that a first end of the contact terminates within the housing. The electrical contact is movable within the slot between a lower position in which a second end of the electrical contact contacts the voltage bus of a first electrical circuit within the track when the adapter is mounted to the track, and an upper position in which the second end of the electrical contact contacts the voltage bus of a second electrical circuit when the adapter is mounted to the track. The electrical contact has a lateral protrusion which creates an interference fit with the slot so as to inhibit the electrical contact from moving between the upper and lower positions. The protrusion is disposed above an upper end of the slot when the electrical contact is in its upper position, and the protrusion is disposed below a lower end of the slot when the electrical contact is in its lower position.

Thus it is an object of the present invention to provide an improved track adapter for track lighting systems.

It is a further object of the present invention to provide a track adapter for dual circuit track lighting systems which includes a mechanism for affirmatively maintaining the voltage contact in its desired position while permitting easy movement of the voltage contact between its two positions.

Another object of the present invention is to provide a track adapter for dual circuit track lighting systems which reduces the likelihood that the voltage contact will be placed in an intermediate position in which the voltage contact fails to contact either voltage bus.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
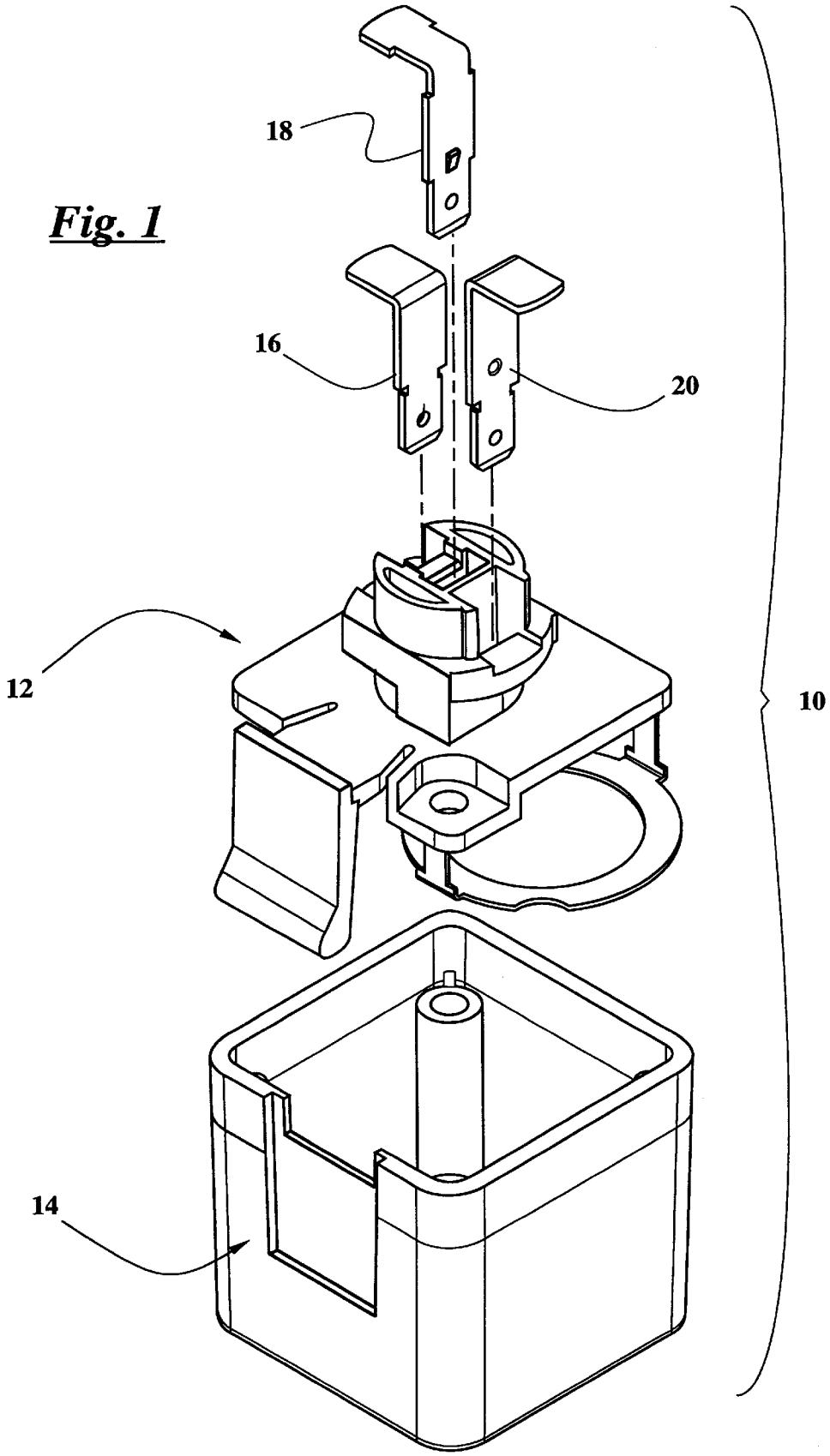
FIG. 1 is an exploded perspective view of a track adapter according to the present invention.

Referring now to the drawings, in which like numerals indicate like elements throughout the several views, FIG. 1 is an exploded view of a track adapter 10 according to the present invention. The track adapter 10 includes a base 12, a housing 14, a neutral electrical contact 16, a ground electrical contact 18, and a voltage electrical contact 20. Each of these components will be discussed more fully below with reference to FIGS. 4–25.

Figures 2, 3:
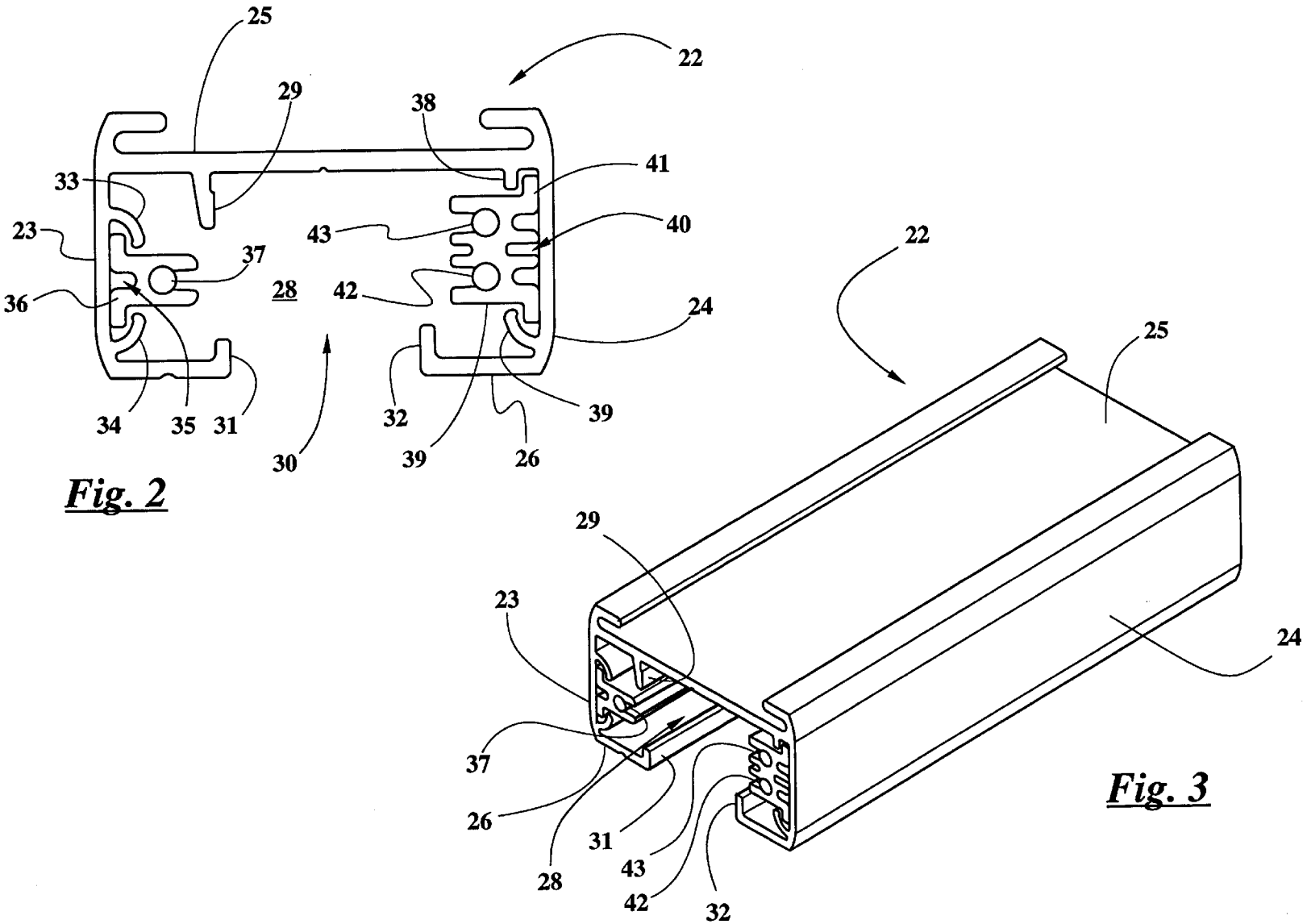
FIG. 2 is an end view of a dual-circuit track with which the track adapter of FIG. 1 is adapted for use.
FIG. 3 is a perspective view of the track of FIG. 2.

FIGS. 2 and 3 illustrate a track 22 having dual electrical circuits. The track 22 is an elongated extrusion of indeterminate length formed from aluminum or other suitable material. The track 22 has first and second side walls 23, 24, a top wall 25, and a bottom wall 26 defining a hollow longitudinal passageway 28. A short vertical grounding rib 29 extends downward from the bottom face of the top wall 25. A channel 30 is formed in the bottom wall 26. Vertical channel walls 31, 32 extend upward from the bottom wall 26. The vertical channel wall 31 is shorter than the vertical channel wall 32.

Brackets 33, 34 define a first pocket 35 on the interior face of the first side wall 23. An insulating element 36 resides within the pocket 35. A neutral bus 37 is carried by the insulating element 36.

Brackets 38, 39 define a second pocket 40 on the interior face of the opposite side wall 24. An insulating element 41 resides within the pocket 40. First and second voltage busses 42, 43 are carried by the insulating element 41.

Figure 7:
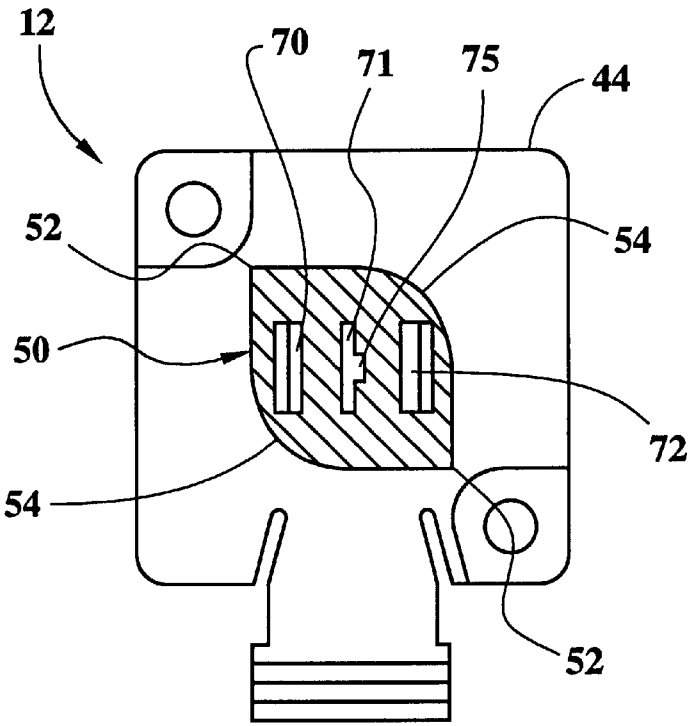
FIG. 7 is a cutaway view taken along line 7—7 of FIG. 5.

The base 12 of the track adapter 10 is shown in FIGS. 4–9. The base 12 includes a panel 44 which is generally square. At two diagonally opposed corners recesses 45 are formed. A smooth bore 46 is formed in the bottom of each recess. A connector 48 extends upward from the central portion of the panel 44. The connector 48 includes a narrow neck portion 50 at its lower end. As can be seen in FIG. 7, two diagonally opposed quarters 52 of the neck 50 are square, and the remaining two diagonally opposed quarters 54 of the neck 50 define 90° arcs.

Figure 5:
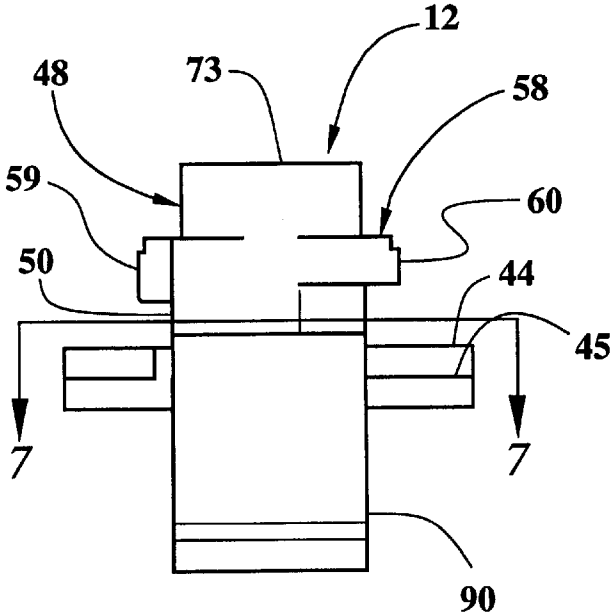
FIG. 5 is a side view of the base of FIG. 4.
Figure 4:
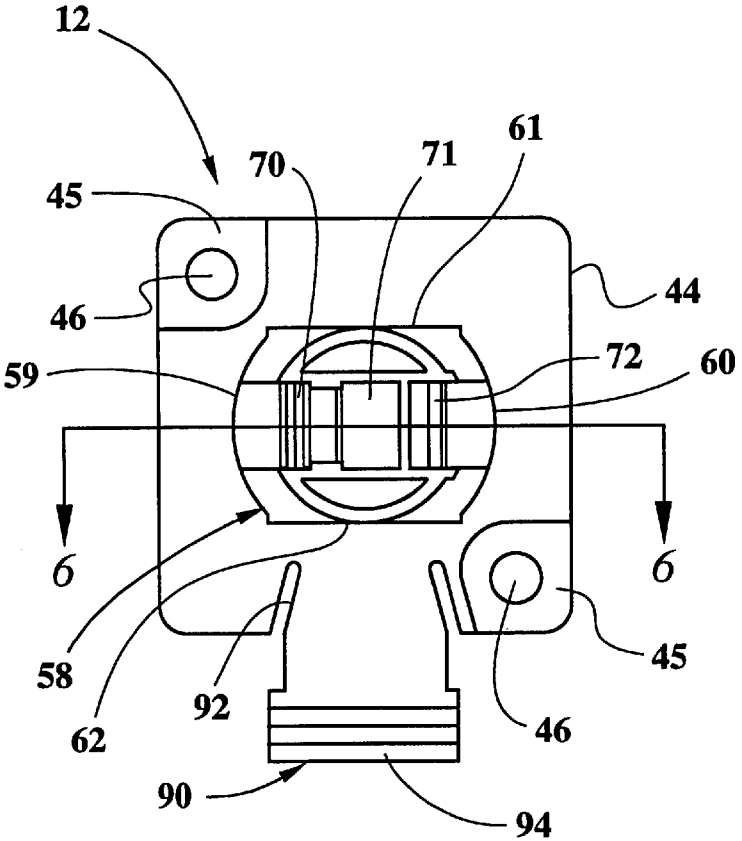
FIG. 4 is a top view of the base of the track adapter of FIG. 1.

Immediately above the neck 50 is an elongated flange 58. The flange 58 includes rounded ends 59, 60 and flat sides 61, 62. As can be seen in FIG. 5, the end 59 of the flange 58 is thicker than the opposite end 60.

Figure 6:
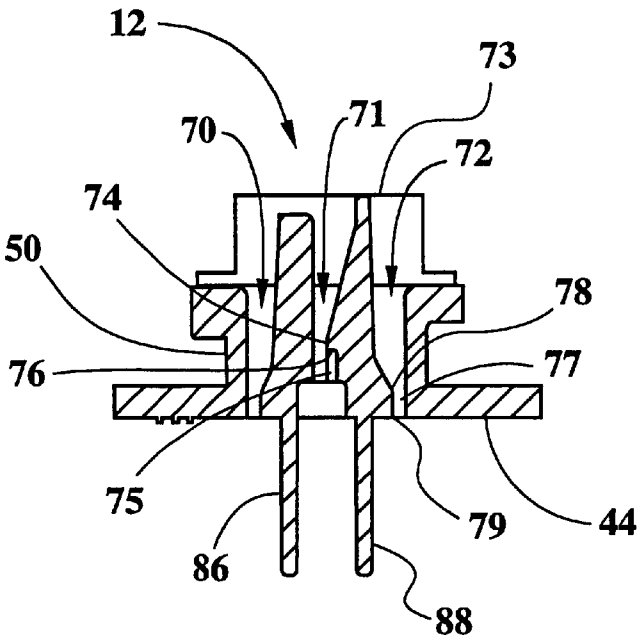
FIG. 6 is a cutaway view taken along line 6—6 of FIG. 4.

With particular reference now to FIG. 6, three elongated slots 70–72 extend from the upper end 73 of the connector 48 through the bottom of the panel 44. As will be seen, the slots 70–72 are each adapted to receive an elongated leg of an electrical contact therethrough.

The center slot 71 has a narrow neck portion 74. A recess 75 having an upper wall 76 is formed in communication with the center slot 71.

The slot 72 includes a short neck portion 77 and shoulders 78, 79 immediately above and below the neck portion 77.

Figure 8:
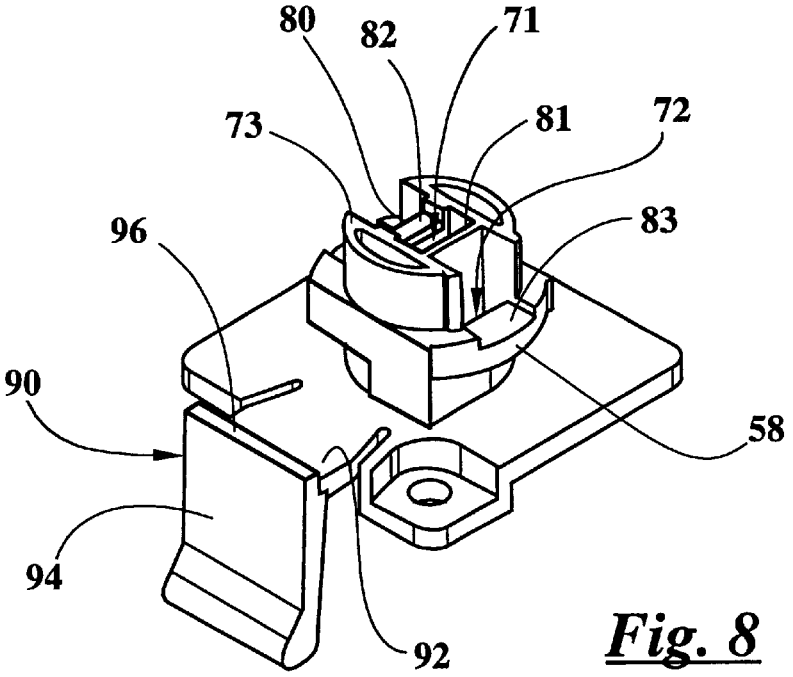
FIG. 8 is a top perspective view of the base of FIG. 4.

Referring now to FIG. 8, the upper end 73 of the connector 48 includes a first wall 80 separating the first slot 70 from the second slot 71 and a second wall 81 separating the second slot 71 from the third slot 72. A recess 82 is formed in the first wall 80. Adjacent the third slot 72 the upper wall of the flange 58 has a recess 83. A similar recess (not shown) is formed in the upper wall of the flange 58 adjacent the first slot 70.

Figure 9:
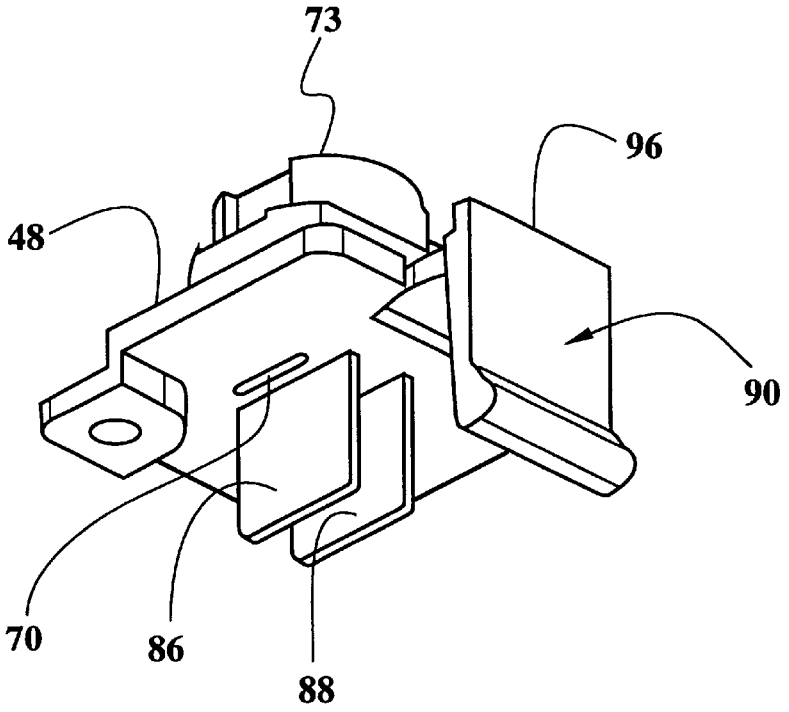
FIG. 9 is a bottom perspective view of the base of FIG. 4.

As can be seen in FIG. 9, dividers 86, 88 extend downward from the lower face of the panel 44. The first divider 86 is disposed between the first and second slots 70, 71, and the second divider 88 is disposed between the second and third slots 71, 72. As will be seen, the purpose of the dividers 86, 88 is to isolate from one another the lower ends of electrical contacts extending downward from the lower face of the panel 44.

A latch 90 extends from one side of the panel 44.

The latch 90 includes a lateral arm 92 extending from the panel 44. A finger-receiving tab 94 extends downward from the free end of the lateral arm 92. A flange 96 extends upward from the free end of the lateral arm 92. The flange 96 has a width approximately corresponding to the width of the channel 30 in the bottom wall 26 of the track 22.

Figure 10:
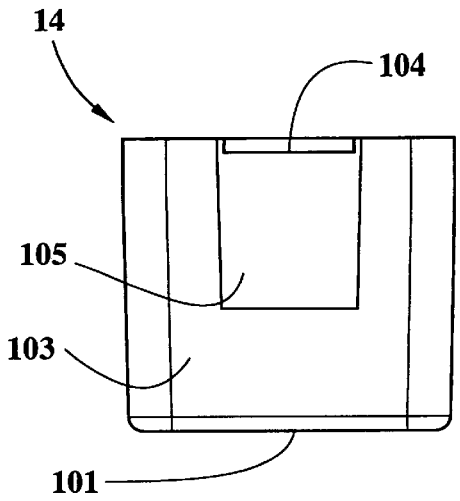
FIG. 10 is a side view of the housing of the track adapter of FIG. 1.
Figure 11:
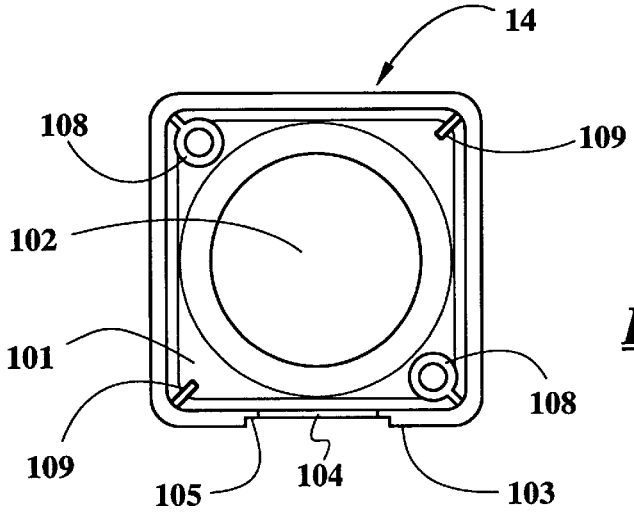
FIG. 11 is a top view of the housing of FIG. 10.
Figure 12:
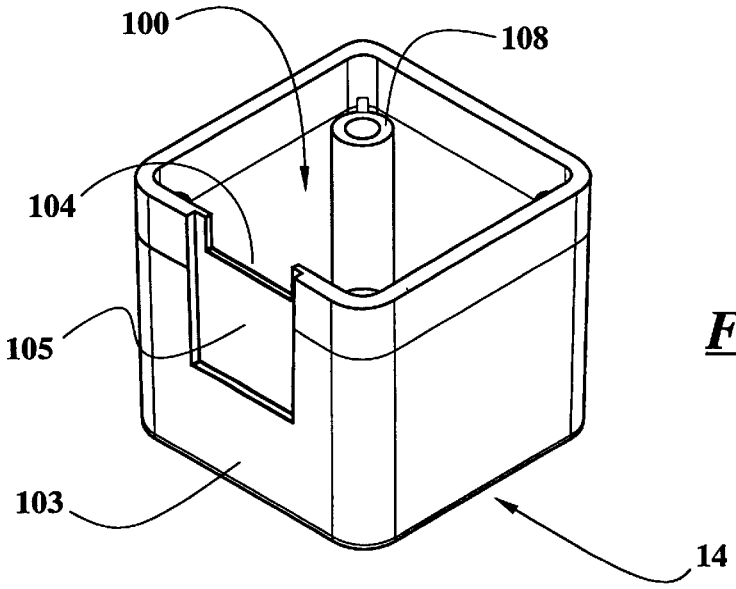
FIG. 12 is a perspective view of the housing of FIG. 10.
Figure 16:
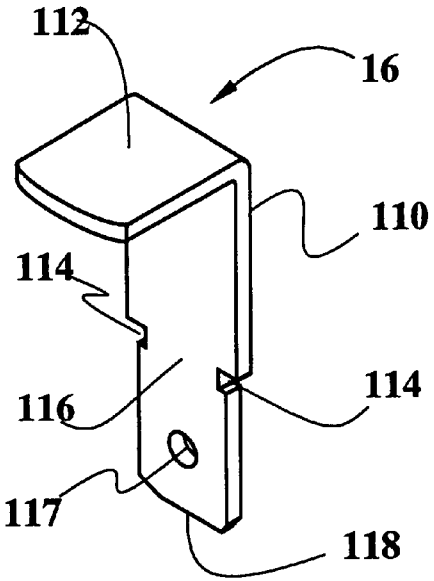
FIG. 16. is a perspective view of the electrical contact of FIG. 13.
Figure 14:
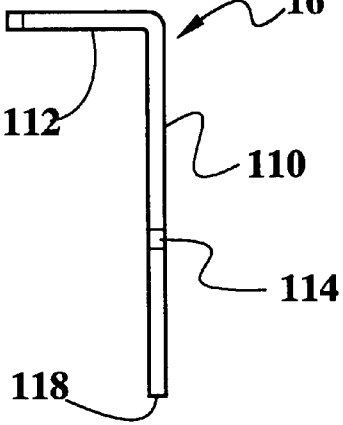
FIG. 14 is a side view of the neutral electrical contact of FIG. 13.
Figure 15:
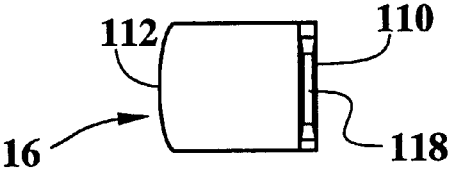
FIG. 15 is a bottom view of the neutral electrical contact of FIG. 13.
Figure 13:
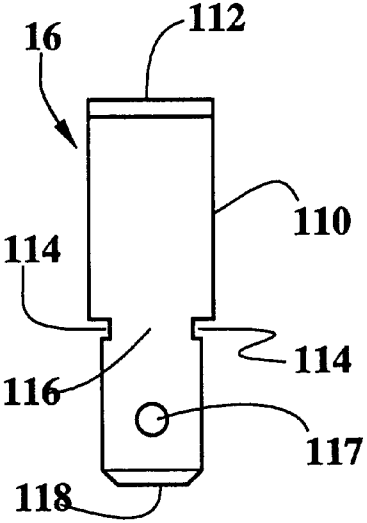
FIG. 13 is a front view of the neutral electrical contact of the track adapter of FIG. 1.
Figure 20:
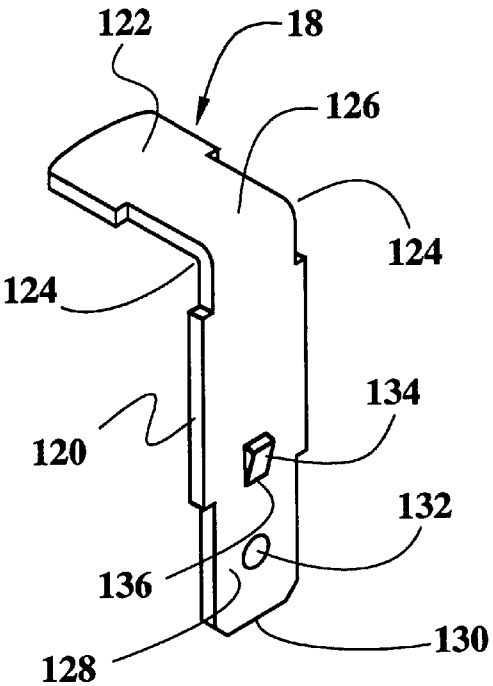
FIG. 20 is a perspective view of the ground electrical contract of FIG. 17.
Figure 18:
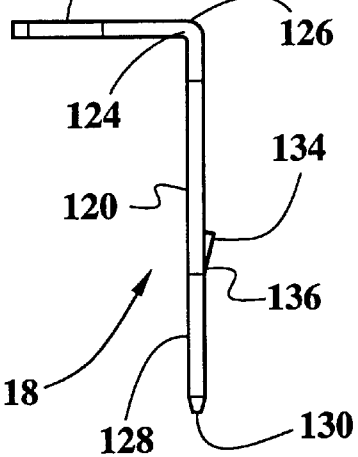
FIG. 18 is a side view of the ground electrical contact of FIG. 17.
Figure 19:
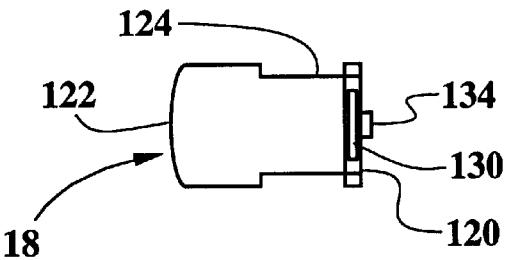
FIG. 19 is a bottom view of the ground electrical contract of FIG. 17.
Figure 17:
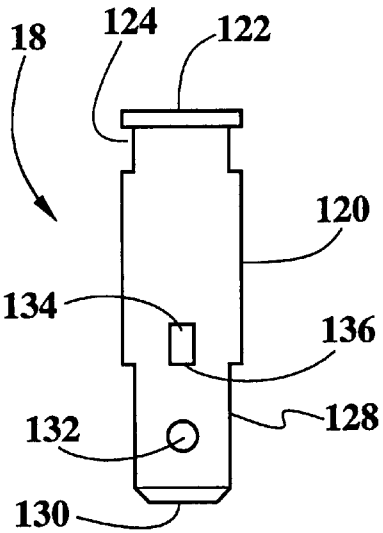
FIG. 17 is a front view of the ground electrical contact of the track adapter of FIG. 1.
Figure 25:
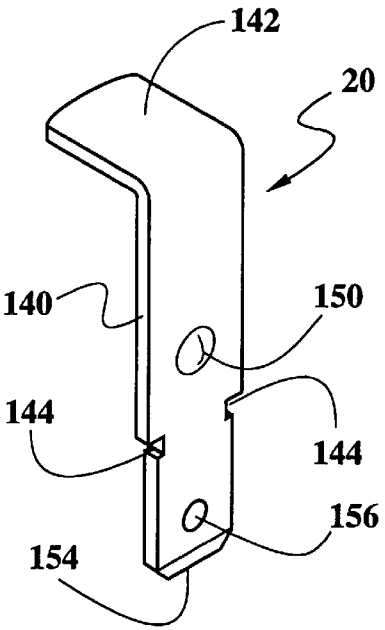
FIG. 25 is a perspective view of the ground electrical contact of FIG. 21.
Figure 22:
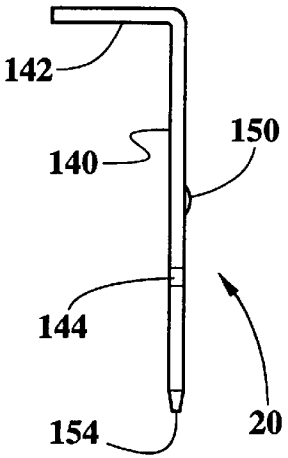
FIG. 22 is a side view of the voltage electrical contact of FIG. 21.
Figure 23:
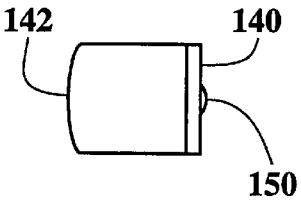
FIG. 23 is a bottom view of the voltage electrical contact of FIG. 21.
Figure 21:
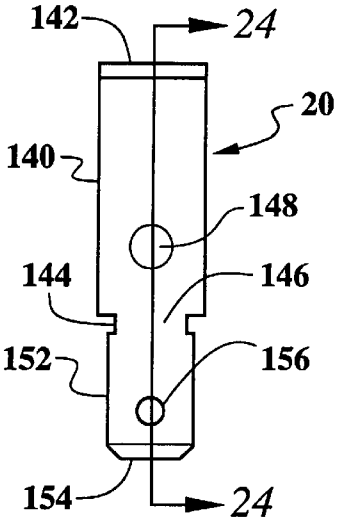
FIG. 21 is a front view of the voltage electrical contact of the track adapter of FIG. 1.
Figure 24:
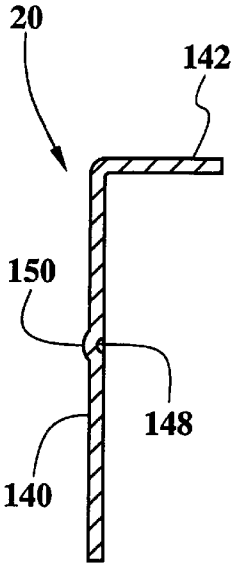
FIG. 24 is a cutaway view taken along line 24-24 of FIG. 21.
Figure 30:
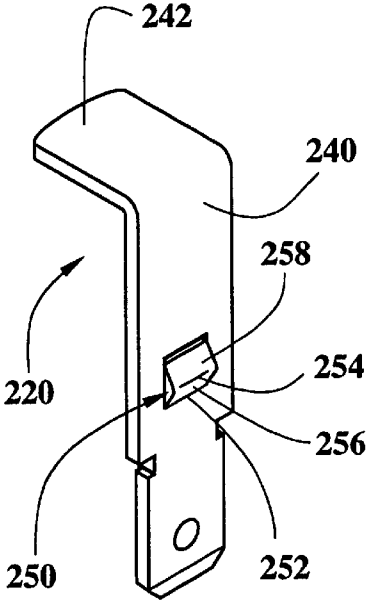
FIG. 30 is a perspective view of the ground electrical contact of FIG. 26.
Figure 27:
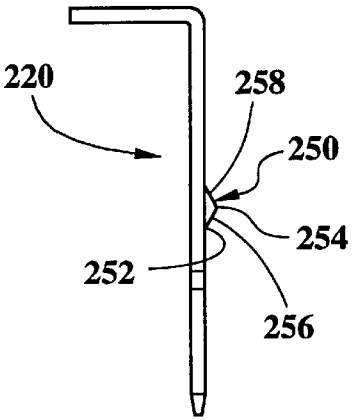
FIG. 27 is a side view of the voltage electrical contact of FIG. 26.
Figure 28:
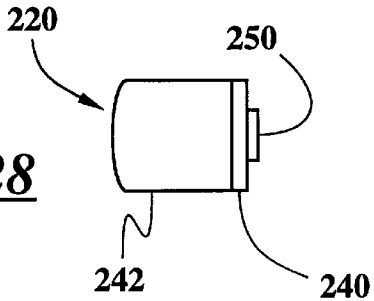
FIG. 28 is a bottom view of the voltage electrical contact of FIG. 26.
Figure 26:
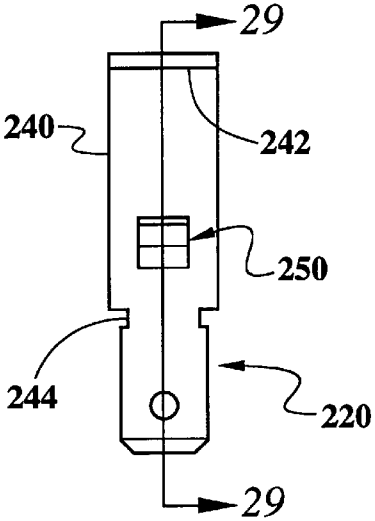
FIG. 26 is a front view of an alternate embodiment of a voltage electrical contact for use in the track adapter of FIG. 1.
Figure 29:
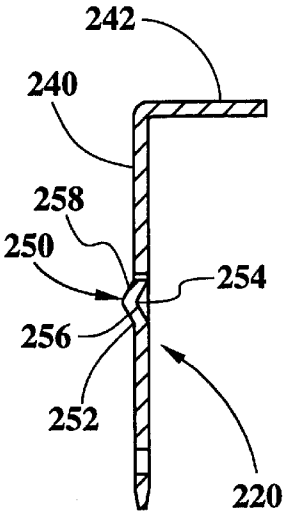
FIG. 29 is a cutaway view taken along line 29—29 of FIG. 26.

Referring now to FIGS. 10–12, the housing 14 is a hollow shell shaped generally like a cube with an open top 100. The bottom face 101 of the housing 14 has a circular hole 102 through which to receive a mounting bracket of a lighting fixture. The front wall 103 of the housing 14 has a notch 104 formed in its central portion to receive the arm 92 of the latch 90 which extends from the base 12. A recess 105 surrounds the notch 104. The recess 105 is configured such that when a user depresses the tab 94 of the latch 90, the recess provides additional clearance to permit increased latch movement.

Screw bosses 108 are formed within the housing 14 in two diagonally opposite comers thereof. Support flanges 109 extend inward from the remaining two comers of the interior of the housing 14.

The neutral electrical contact 16 is illustrated in FIGS. 13–16. A neutral contact 16 is generally L-shaped and includes an elongated vertical leg 110 and a shorter horizontal leg 112. Notches 114 are formed on opposite sides of the vertical leg 110 approximately two-thirds of the way down the leg to create a line of weakness 116 to facilitate bending the leg, for reasons which will be explained herein below.

The lower portion of the vertical leg 110 below the notches 114 has a width and thickness adapted to interface with an industry standard connector (not shown) such as the "Amp" connector available from AMP, Incorporated, of Harrisburg, Pa., USA. A hole 117 is formed in the lower portion of the vertical leg 110 to receive a snap-on locking lug of the Amp connector. The lower end 118 of the vertical leg 110 has a tapered width and thickness to facilitate installation of the Amp connector onto the neutral contact 16.

Referring now to FIGS. 17–20, the ground contact 18 is substantially L-shaped and includes an elongated vertical leg 120 and a horizontal leg 122. Recesses 124 are formed along opposite sides of the ground connector 18 along the junction between the vertical and horizontal legs 120, 122 to form a narrowed neck portion 126.

The lower portion 128 of the vertical leg 120 has a width and thickness adapted to interface with an Amp connector, and the bottom edge 130 of the vertical leg has a tapered width and thickness to facilitate the installation of the Amp connector. A hole 132 is formed in the lower portion of the vertical leg 120 to receive a snap-on locking lug of the Amp connector.

A retention tab 134 is punched in the vertical leg 120. The lower end 136 of the retention tab 134 remains attached to the vertical leg 120, and the retention tab 134 extends upward and rearward.

Referring now to FIGS. 21–25, the voltage contact 20 is substantially L-shaped and includes an elongated vertical leg 140 and a horizontal leg 142. Notches 144 on opposite sides of the vertical leg 140 create a line of weakness 146 to facilitate bending the vertical leg, for reasons which will be explained herein below. A dimple 148 is punched into the front of the vertical leg 140, causing a bulge or locator stop 150 to project from the rear surface of the vertical leg 140.

The lower portion 152 of the vertical leg 140 of the voltage contact 20 has a width and thickness adapted to interface with an Amp connector. The lower edge 154 of the voltage contact 20 is tapered in width and thickness to facilitate attaching the Amp connector. A hole 156 is formed in the lower portion of the vertical leg 140 to receive a snap-on locking lug of the Amp connector.

FIGS. 26–30 show an alternate embodiment of a voltage contact 220. Like the voltage contact 20, the alternate embodiment of the voltage contact 220 is essentially L-shaped and includes an elongated vertical leg 240 and a horizontal leg 242. Notches 244 are formed on opposite sides of the vertical leg 240 to create a line of weakness between the notches to facilitate bending of the vertical leg 240. The features of the alternate embodiment 220 of the voltage contact thus far described are the same as the corresponding elements of the voltage contact 20 described above.

In the central portion of the vertical leg 240 of the voltage contact 220, a locator stop tab 250 is punched. The lower end 252 of the locator stop tab 250 is attached to the vertical leg 240. The locator stop tab 250 is bent at its midpoint 254 to form a lower leg 256 and an upper leg 258. The lower leg 256 of the locator stop tab 250 extends upward and rearward from its lower end 252, and the upper leg 258 extends upward and forward from the tab's midpoint 254. The locator stop tab 250 thus forms a stop which projects rearward from the back surface of the vertical leg 240 of the voltage contact 220.

Figure 31:
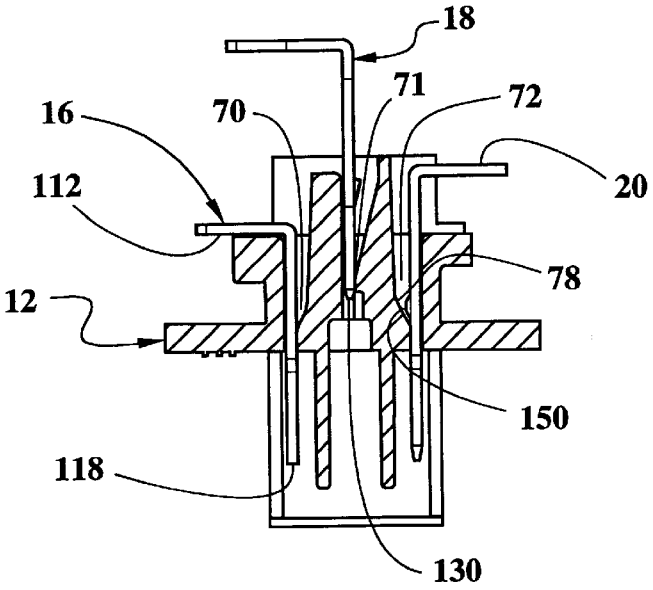
FIG. 31 is a transverse cutaway view of the base of FIGS. 4–9 showing the electrical contacts of FIGS. 13–25 mounted thereto.
Figure 32:
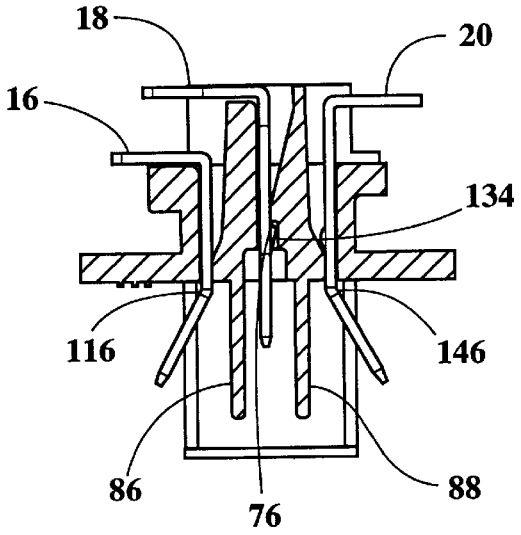
FIG. 32 is a transverse cutaway view of the base of FIGS. 4–9 and the electrical contacts of FIGS. 13–25 showing the neutral and voltage electrical contacts bent to secure them to the base and showing the voltage electrical contact in its upper position.

Assembly of the track adapter 10 will now be described with respect to FIGS. 31–33. To install the neutral electrical contact 16 in the base 12, the lower end 118 of the neutral electrical contact is inserted through the slot 70 in the base. The vertical leg 110 of the neutral contact 16 is advanced until the horizontal leg 112 of the neutral contact rests on the base 12, as shown in FIG. 31. The lower portion of the neutral contact 16 is then bent outward approximately 30°, as shown in FIG. 32, along the line of weakness 116 created by the notches 114. This bend prevents the neutral contact 16 from being pulled upward and out of the base 12.

The ground contact 18 is installed in the base 12 as follows. The lower end 130 of the ground contact 18 is inserted downward through the slot 71 in the base 12, as shown in FIG. 31, until the horizontal leg 122 rests within the recess 82 in the upper end 73 of the connector 48. Because the width of the recess 82 is smaller than the width of either the neutral contact 16 or the voltage contact 20, the possibility of the wrong contact being inserted into the slot 71 is minimized. The retention tab 134 on the vertical leg 120 deflects inward as it is inserted through the narrow neck portion 74 of the slot 71 and then springs outward into the recess 75. The free end of the retention tab 134 engages the upper wall 76 of the recess 75 as shown in FIG. 32 to prevent the ground contact 18 from being pulled upward out of the base 12.

The voltage contact 20 is installed in the base 12 as follows. The lower end 154 of the voltage electrical contact 20 is inserted through the slot 72 in the base 12 and advanced until the locator stop 150 rests on the upper shoulder 78 just above the narrow neck portion 77 of the slot 72. The lower portion of the vertical leg 140 is then bent outward approximately 30°, as shown in FIG. 32, along the line of weakness 146 created by the notches 144. This bend prevents the voltage contact 20 from being pulled upward and out of the base 12.

With the contacts 16, 18, 20 thus installed, the ends of the electrical wires of the light fixture (not shown) are inserted upward through the circular hole 102 in the housing 14. Amp connectors (also not shown) attached to the ends of the neutral, ground, and voltage wires are then connected to the respective neutral, ground, and voltage contacts 16, 18, 20. The dividers 86, 88 extending downward from the panel 44 of the base 12 keep the lower ends of the contacts and their respective wires electrically isolated.

Figure 33:
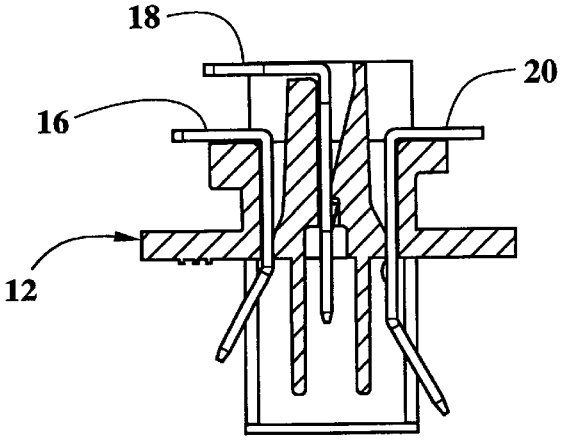
FIG. 33 is a transverse cutaway view of the base of FIGS. 2–6 with the electrical contacts of FIGS. 13–25 mounted thereto and showing the voltage contact in its lower position.
Figure 34:
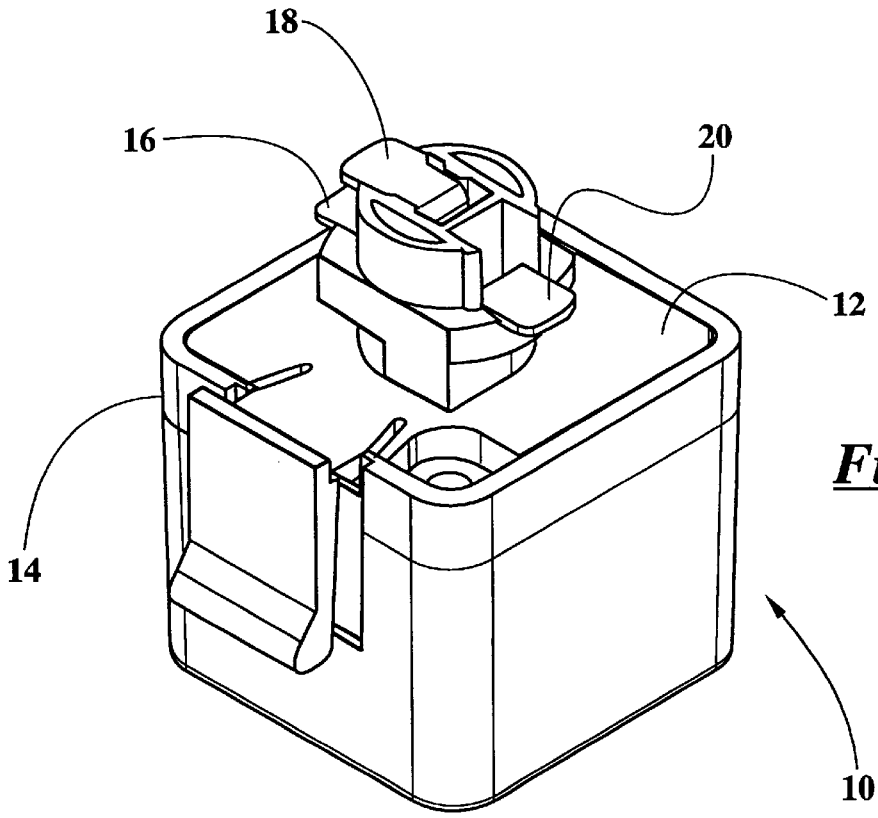
FIG. 34 is a perspective view of the assembled track adapter of FIG. 1 showing the voltage electrical contact in its lower position.

If the lighting fixture is to be connected to the first electrical circuit, the voltage contact 20 is depressed to its lower position, as shown in FIGS. 33 and 34, in which the horizontal leg 142 of the contact rests within the recess 83 in the base 12. As the voltage contact is move into this position the stop 150 on the back wall of the vertical leg 140 of the voltage contact 20 is depressed as it is forced through the neck 77 of the slot 72. Upon clearing the lower end of the neck 77, the stop 150 engages the lower shoulder 79 and prevents the contact from inadvertently becoming displaced from its lower position.

Figure 35:
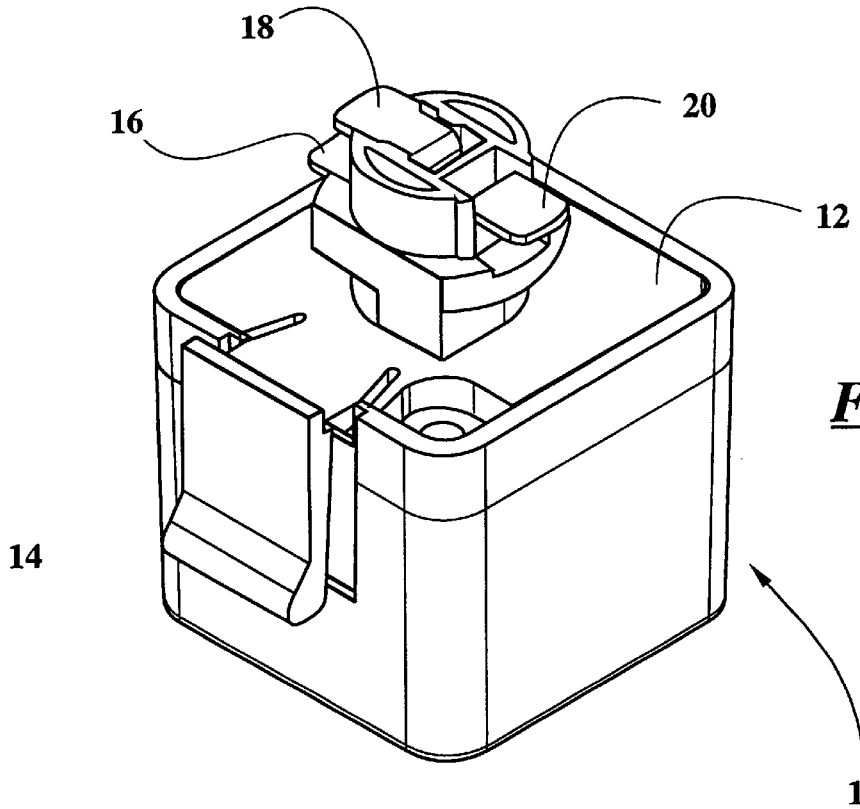
FIG. 35 is a perspective view of the assembled track adapter of FIG. 1 showing the voltage electrical contact in its upper position.

If the lighting fixture is to be connected to the second electrical circuit, the voltage contact 20 is raised to its upper position, as shown in FIGS. 32 and 35. In this position the locator stop 150 on the back wall of the vertical leg 140 of the voltage contact 20 rests on the upper shoulder 78 of the slot 72 and prevents the voltage contact from slipping downward.

With the track adapter 10 thus assembled to its associated light fixture, the adapter is now mounted to the track 22. The track adapter 10 is first aligned with the track 22 by rotating the adapter until the major axis of the flange 58 is aligned with the longitudinal axis of the track. The major axis of the elongated flange 58 is wider than the channel 30 in the bottom of the track 22, while the minor axis of the elongated flange 58 is sufficiently narrow to fit through the channel in the bottom of the track. With the track adapter 10 thus aligned, the connector 48 is then inserted upward through the channel 30 in the bottom wall 26 of the track 22. The neck 50 of the connector 48 now resides within the channel 30. Because the neck 50 is configured with two square corners 52, the track adapter 10 can be rotated in only one direction. In addition, because one channel wall 32 is taller than the other channel wall 31, and one end 59 of the flange 58 is thicker than the other end 60, the track adapter 10 can be turned only with the thicker end 59 of the flange 58 rotating toward the shorter channel wall 31. This arrangement assures proper polarity, that is, the voltage contact 20 will rotate toward the voltage busses 42, 43, and the neutral contact 16 will rotate toward the neutral bus 37. If the track adapter 10 has inadvertently been oriented such that rotation of the adapter in the direction mandated by the neck portion 50 would bring the thicker end 59 of the flange 58 toward the taller channel wall 32, the connector 48 must be withdrawn from the channel 30, rotated 180°, and then reintroduced.

When the track adapter 10 is properly positioned within the channel 30, the adapter is rotated 90° to bring the major axis of the elongated flange 58 perpendicular to the longitudinal axis of the track 22. The lower surfaces of the flange 58 ride on the top of the channel walls 31, 32 to retain the track adapter 10 on the track 22.

Figure 37:
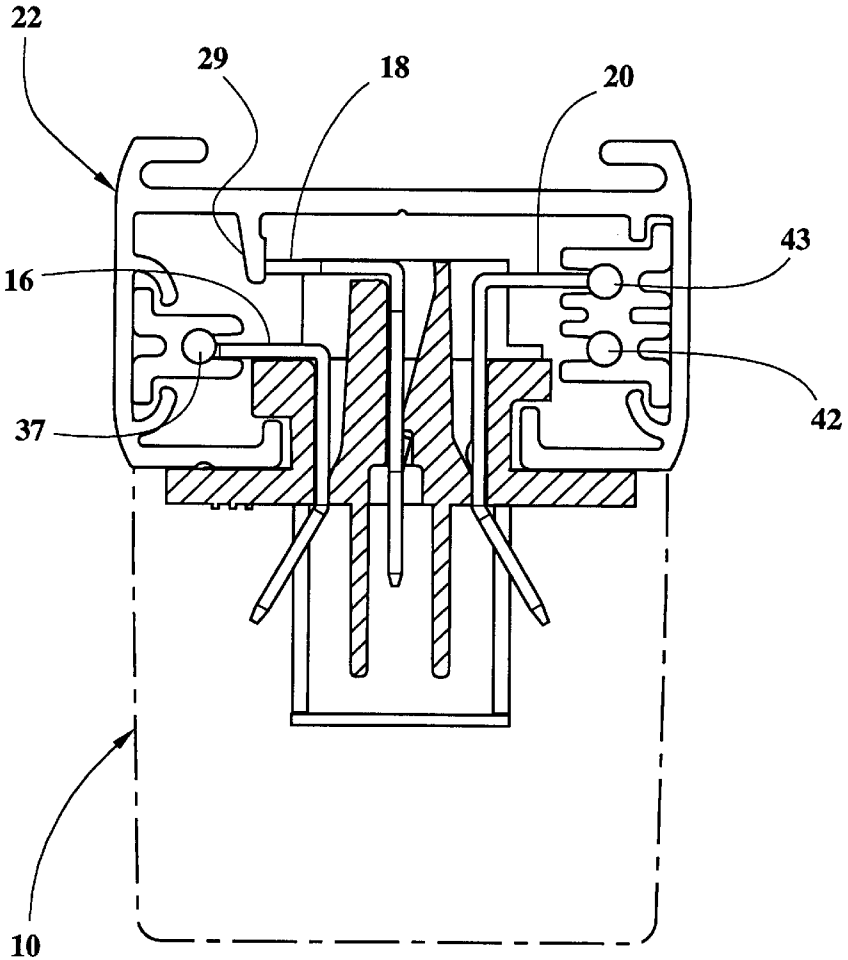
FIG. 37 is an end view of the track of FIG. 2 with the track adapter of FIG. 1 mounted thereto and with the voltage electrical contact in its upper position to engage a second voltage bus.
Figure 36:
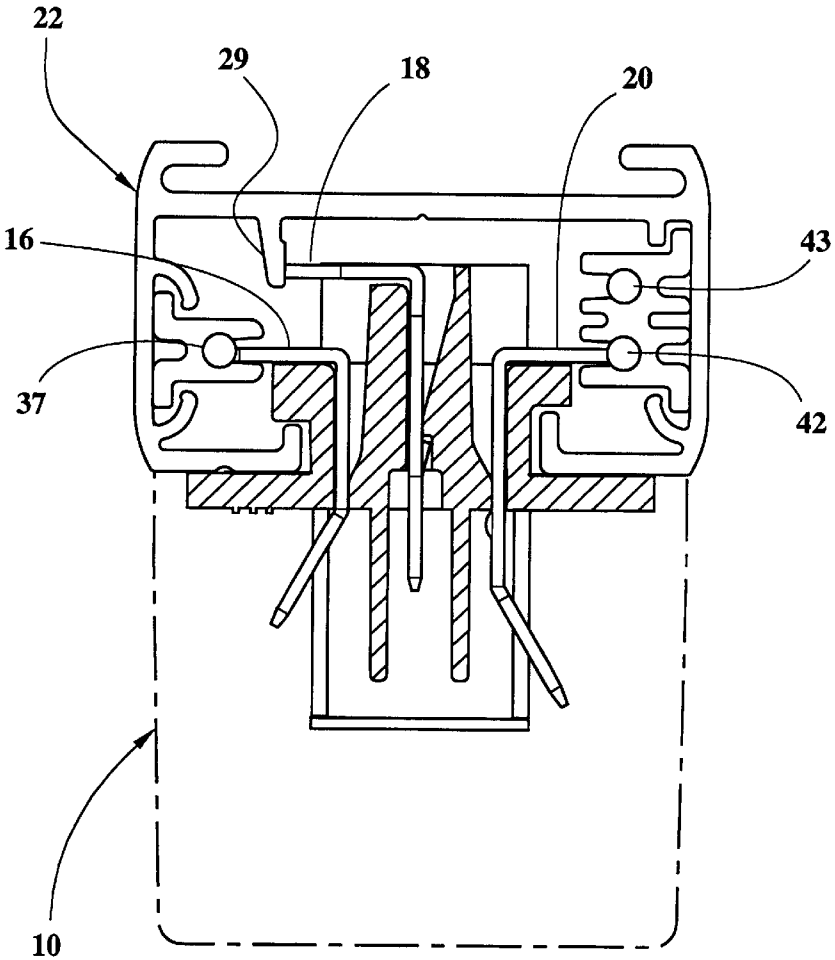
FIG. 36 is an end view of the track of FIG. 2 with the track adapter of FIG. 1 mounted thereto and with the voltage electrical contact in its lower position to engage a first voltage bus.

FIGS. 36 and 37 illustrate the track adapter 10 installed onto the track 22. The end of the neutral contact 16 engages the neutral bus 37, and the end of the ground contact 18 engages the grounding rib 29. As shown in FIG. 36, when the voltage contact 20 is in its lower position, the end of the contact touches the first voltage bus 42. As shown in FIG. 37, when the voltage contact 20 is in its upper position, the end of the contact touches the second voltage bus 43.

Assembly and use of a track adapter 10 using the voltage contact 220 of the alternate embodiment is very similar to that of the first embodiment using the of the voltage contact 20. When the voltage contact 220 is in its upper position, the locator stop tab 250 on the vertical leg 240 engages the shoulder 78 to prevent the voltage contact 220 from accidentally becoming displaced downward. When the voltage contact 220 is in its lower position, the locator stop tab 250 on the vertical leg 240 engages the shoulder 79 to prevent the voltage contact 220 from accidentally becoming displaced upward. When the voltage contact 220 is being moved between its upper and lower positions, the locator stop tab 250 is depressed by contact with the walls of the narrow neck portion 77, springing back to its normal protruding position once the tab has cleared the neck.

The interaction between the locator stops 50, 250 of the voltage contacts 20, 220 provides significant advantages over prior art track adapters for dual circuit tracks. First, the engagement of the shoulders 78, 79 of the adapter base 12 by the locator stops 50, 250 inhibits the voltage contact from being accidentally displaced from its intended position. Further, once the installer exerts sufficient force to move the locator stop 50, 250 downward past the upper shoulder 78 or upward past the lower shoulder 79, the force is usually sufficient to cause the contact to snap all the way into the opposite position. Thus the possibility of the contact being left in an intermediate position which contacts neither the first voltage bus 40 nor the second voltage bus 41 is minimized.

Similarly the interaction between the retention tab 134 of the ground contact 18 and the upper wall 76 of the recess 75 provides significant advantages. The snap-in configuration eliminates the need for a separate fastening means, such as a screw, to anchor the ground contact 18, thus reducing the cost of materials and reducing assembly time.

Finally, it will be understood that the preferred embodiment has been disclosed by way of example, and that other modifications may occur to those skilled in the art without departing from the scope and spirit of the appended claims.

What is claimed is:

1. A track adapter for electrically connecting a light fixture to either of two electrical circuits of a track, comprising:

a housing;

a housing base having a slot formed therein;

an electrical contact having an elongated leg which is received through said slot, a first end of said electrical contact terminating within said housing, and said electrical contact being movable within said slot between a lower position in which a second end of said electrical contact conductively communicates with a first voltage bus of a track when said adapter is mounted to said track, and an upper position in which said second end of said electrical contact conductively communicates with a second voltage bus of a track when said adapter is mounted to said track, said electrical contact comprising a lateral protrusion projecting from an intermediate location on said elongated leg which creates an interference fit with said slot so as to inhibit said electrical contact from moving between said lower and upper positions, said protrusion being disposed above an upper end of said slot when said electrical contact is in said upper position, and said protrusion being disposed below a lower end of said slot when said electrical contact is in said lower position.

2. The track adapter of claim 1, wherein said slot in said housing base comprises a first slot, wherein said housing base further comprises second and third slots formed therein, and wherein said electrical contact comprises a first electrical contact, said adapter further comprising:

a second electrical contact having an elongated leg which is received through said second slot, a first end of said second electrical contact terminating within said housing, and a second end of said second electrical contact being disposed to conductively communicate with a neutral bus of said track when said adapter is mounted to said track; and a third electrical contact having an elongated leg which is received through said third slot, a first end of said third electrical contact terminating within said housing, and a second end of said third electrical contact being disposed to conductively communicate with a ground element of said track when said adapter is mounted to said track.

3. The track adapter of claim 1, wherein said lateral protrusion comprises a dimple punched in said elongated leg.

4. The track adapter of claim 1, wherein said lateral protrusion comprises a tab punched in said elongated leg of said electrical contact so as to protrude laterally therefrom.

5. The track adapter of claim 1, wherein said elongated leg of said electrical contact comprises a first leg, wherein said elongated first leg comprises an upper end, and wherein said electrical contact further comprises a second leg extending substantially perpendicularly from said upper end of said elongated first leg, said second leg having a free end, and said free end comprising said second end of said electrical contact which conductively communicates with said voltage buses of said track.

6. The track adapter of claim 5, wherein said second leg of said electrical contact comprises a portion which engages a portion of said housing when said electrical contact is in said lower position, such that said electrical contact is prevented from moving below said lower position.

7. The track adapter of claim 6, wherein said portion of said housing which is engaged by said second leg of said electrical contact when said electrical contact is in said lower position is spaced apart from said lower end of said slot by a predetermined distance, and wherein lateral protrusion is spaced downward from said upper end of said elongated leg by a distance which is substantially equal to said predetermined distance, whereby said lateral protrusion inhibits said electrical contact from moving upward when said electrical contact is in said lower position.

* * * * *